US006936799B2

(12) United States Patent
Kim et al.

(10) Patent No.: US 6,936,799 B2
(45) Date of Patent: Aug. 30, 2005

(54) INDUCTION HEATING COOKER AND METHOD FOR OPERATING THE SAME

(75) Inventors: Eui Sung Kim, Kyungki-do (KR); Seung Hee Ryu, Kyungki-do (KR); Byeong Wook Park, Inchun-si (KR); Dong Myung Shin, Kyungki-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/956,024

(22) Filed: Oct. 4, 2004

(65) Prior Publication Data

US 2005/0087526 A1 Apr. 28, 2005

(30) Foreign Application Priority Data

Oct. 27, 2003 (KR) ..... 10-2003-0075068

(51) Int. Cl.[7] ..... H05B 6/06; H05B 6/12

(52) U.S. Cl. ..... 219/626; 219/625; 219/663; 219/649

(58) Field of Search ..... 219/625–627, 219/621, 649, 661–668; 99/DIG. 14

(56) References Cited

U.S. PATENT DOCUMENTS 3,775,577 A 11/1973 Peters, Jr.
5,648,008 A * 7/1997 Barritt et al. ..... 219/626
6,153,863 A 11/2000 Snowball
6,812,440 B2 * 11/2004 Hirota et al. ..... 219/626

FOREIGN PATENT DOCUMENTS

EP 1 347 669 9/2003
JP 03-114196 * 5/1991 ..... 219/626

* cited by examiner

*Primary Examiner*—Philip H. Leung
(74) *Attorney, Agent, or Firm*—Birch, Stewart, Kolasch & Birch, LLP

(57) ABSTRACT

An induction heating cooker capable of accurately discriminating whether the material of a cooking container placed in the induction heating cooker is magnetic or non-magnetic, using a phase change in a resonant capacitor voltage of an inverter circuit and a switching pulse signal of the inverter circuit, irrespective of the load of the cooking container, and a method for operating the induction heating cooker. The induction heating cooker includes a power supply for rectifying an AC voltage, filtering the rectified voltage, and supplying the filtered voltage as an input voltage of the induction heating cooker, an inverter circuit for heating a cooking container placed in the induction heating cooker, using the voltage supplied from the power supply, and a container material discriminating unit for discriminating whether a material of the cooking container is magnetic or non-magnetic, based on a resonant capacitor voltage of the inverter circuit and a switching pulse signal of the inverter circuit, upon an initial operation of the induction heating cooker, whereby the cooking container is selectively heated in accordance with the result of the discrimination.

11 Claims, 5 Drawing Sheets

INDUCTION HEATING COOKER AND METHOD FOR OPERATING THE SAME

This Non-provisional application claims priority under 35 U.S.C. § 119(a) on Patent Application No(s). 10-2003-0075068 filed in Korea, Republic of on Oct. 27, 2003, the entire contents of which are hereby incorporated by reference.

BACKGROUND OF THE INVENTION

1. Field of the Invention

The present invention relates to an induction heating cooker and a method for operating the same, and more particularly to an induction heating cooker which includes a container material discriminating unit capable of accurately discriminating whether the material of a cooking container placed in the induction heating cooker is magnetic or non-magnetic, based on a phase change in a resonant capacitor voltage of an inverter circuit caused by a difference between resonance characteristics of a magnetic load and resonance characteristics of a non-magnetic load, and a method for operating the induction heating cooker.

2. Description of the Related Art

An example of a conventional induction heating cooker is illustrated. The configuration of the conventional induction heating cooker and problems incurred therein will be described below with reference to FIG. 1. FIG. 1 is a block diagram illustrating configurations of an inverter circuit and a container material discriminating unit included in the conventional induction heating cooker.

The induction heating cooker includes an inverter circuit for generating a magnetic field by causing current to flow through a coil in accordance with a switching operation of a switch element, and inducing the magnetic field into a cooking container placed in the induction heating cooker, thereby generating eddy current to heat the cooking container.

The inverter circuit includes an AC power source adapted to supply a general AC voltage, a rectifier adapted to rectify the AC voltage supplied from the AC power source, a filter adapted to filter the rectified voltage outputted from the rectifier, and a switching unit adapted to perform a switching operation in response to the filtered voltage outputted from the filter, thereby applying a high-power, high-frequency voltage to the coil.

Such a conventional induction heating cooker also includes a container material discriminating unit. This container material discriminating unit will be described in detail with reference to FIG. 1. The container material discriminating unit includes a current detecting unit 1 adapted to detect current flowing through the coil of the inverter circuit, and a voltage comparing unit 2 adapted to compare a DC voltage outputted from the current detecting unit 1 with a reference voltage, which is a divided voltage obtained by two resistors.

The current detecting unit 1 includes a current detector, a diode, and a capacitor. The current detector detects high-frequency sine wave current components from current flowing through the coil of the inverter circuit. The detected current is rectified and smoothed by the diode and capacitor, so that a DC voltage is outputted from the current detecting unit 1.

The DC voltage outputted from the current detecting unit 1 is inputted to the voltage comparing unit 2. In the voltage level comparing unit 2, the DC voltage is compared with a reference voltage, which has a predetermined voltage level for discrimination of a magnetic or non-magnetic load. When the DC voltage is less than the reference voltage, the voltage comparing unit 2 determines that the cooking container is a magnetic load, and generates a corresponding discrimination signal. On the other hand, when the DC voltage is more than the reference voltage, the voltage comparing unit 2 determines that the cooking container is a non-magnetic load, and generates a corresponding discrimination signal.

The discrimination signal generated from the voltage comparing unit 2 is applied to a microcomputer 3. When the microcomputer 3 determines, based on the discrimination signal, that the cooking container is a magnetic load, it activates the inverter circuit to heat the cooking container. On the other hand, when the microcomputer 3 determines that the cooking container is a non-magnetic load, it does not activate the inverter circuit, and controls the cooker to operate appropriately.

However, the above-mentioned conventional container material discriminating unit has problems. For example, when the DC voltage indicative of the value of the current detected by the current detecting unit 1 has a level equal to or approximate to the reference voltage, the voltage comparing unit 2, which discriminates the material of the cooking container, may operate erroneously. In this case, the induction heating cooker may operate erroneously.

In order to detect the high-frequency coil current generated from the inverter circuit, it is necessary to use an expensive current detector, which is made of a ferrite material. For this reason, there is an increase in manufacturing costs.

SUMMARY OF THE INVENTION

The present invention has been made in view of the above-mentioned problems incurred in the related art, and an object of the invention is to provide an induction heating cooker which includes a container material discriminating unit capable of accurately discriminating whether the material of a cooking container placed in the induction heating cooker is magnetic or non-magnetic, using a phase change in a resonant capacitor voltage of an inverter circuit and a switching pulse signal of the inverter circuit, irrespective of the load of the cooking container, and a method for operating the induction heating cooker.

In accordance with one aspect, the present invention provides an induction heating cooker comprising: a power supply for rectifying an AC voltage, filtering the rectified voltage, and supplying the filtered voltage as an input voltage of the induction heating cooker; an inverter circuit for heating a cooking container placed in the induction heating cooker, using the voltage supplied from the power supply; and a container material discriminating unit for discriminating whether a material of the cooking container is magnetic or non-magnetic, based on a resonant capacitor voltage of the inverter circuit and a switching pulse signal of the inverter circuit, upon an initial operation of the induction heating cooker, whereby the cooking container is selectively heated in accordance with the result of the discrimination.

The container material discriminating unit may comprise: a voltage detecting unit for detecting the resonant capacitor voltage of the inverter circuit, half-wave rectifying the detected voltage, dividing the half-wave-rectified voltage, and outputting the divided voltage as the result of the detection; and a logic determining unit for comparing the voltage outputted from the voltage detecting unit with the switching pulse signal of the inverter circuit, thereby outputting a pulse signal having a pulse width varying depending on whether the material of the cooking container is magnetic or nonmagnetic.

The container material discriminating unit may further comprise: a DC voltage smoothing unit for converting the pulse signal outputted from the logic determining unit into a DC voltage; and a microcomputer for determining, based on the DC voltage, whether the material of the cooking container is magnetic or non-magnetic, and controlling the inverter circuit, based on the result of the determination.

The logic determining unit may comprise an AND gate for outputting a pulse signal having a pulse width varying in accordance with a variation in load depending on the material of the cooking container such that the pulse width of the pulse signal varies within a range from ¼ to ½ of a period of the switching pulse signal when the material of the cooking material is magnetic, while varying within a range from 0 to ¼ of the period of the switching pulse signal when the material of the cooking material is non-magnetic.

The microcomputer may comprise: a magnetic material determining unit for comparing the DC voltage outputted from the DC voltage smoothing unit with a reference value, thereby determining that the material of the cooking container is magnetic when the DC voltage is not less than ¼ of the control voltage source(Vce), while determining that the material of the cooking container is non-magnetic when the DC voltage is less than ¼ of the control voltage source(Vce); and an inverter controller for activating the inverter circuit when it is determined that the material of the cooking container is magnetic, so as to heat the cooking container.

In accordance with another aspect, the present invention provides a method for operating an induction heating cooker, comprising the steps of: A) operating an inverter circuit included in the induction heating cooker upon an initial operation of the induction heating cooker; B) outputting, as a material discriminating signal, a pulse signal having a pulse width varying depending on a material of a cooking container placed in the induction heating cooker, based on a resonant capacitor voltage of the inverter circuit and a switching pulse signal of the inverter circuit; C) determining whether the material of the cooking container is magnetic or non-magnetic, based on the material discriminating signal outputted at the step B); and D) operating the inverter circuit when it is determined at the step C) that the material of the cooking container is magnetic, thereby heating the cooking container.

The step C) may comprise the steps of: converting the pulse signal outputted at the step B) into a DC voltage; comparing the DC voltage with a predetermined reference value; determining that the material of the cooking container is magnetic when the DC voltage has a level not less than 25% of the control voltage source(Vce); and determining that the material of the cooking container is non-magnetic when the DC voltage has a level less than 25% of the control voltage source(Vce).

In accordance with the present invention, it is possible to accurately discriminate the material of the cooking container, irrespective of the load of the cooking container. Thus, it is possible to prevent the induction heating cooker from operating erroneously due to an erroneous determination of the container material discriminating unit as to the material of the cooking container.

BRIEF DESCRIPTION OF THE DRAWINGS

The above objects, and other features and advantages of the present invention will become more apparent after reading the following detailed description when taken in conjunction with the drawings, in which.

DESCRIPTION OF THE PREFERRED EMBODIMENTS

Now, embodiments of an induction heating cooker according to the present invention will be described in detail with reference to the annexed drawings.

Although there may be various embodiments associated with the induction heating cooker according to the present invention, the following description will be given in conjunction with the most preferred embodiment.

Figure 1:
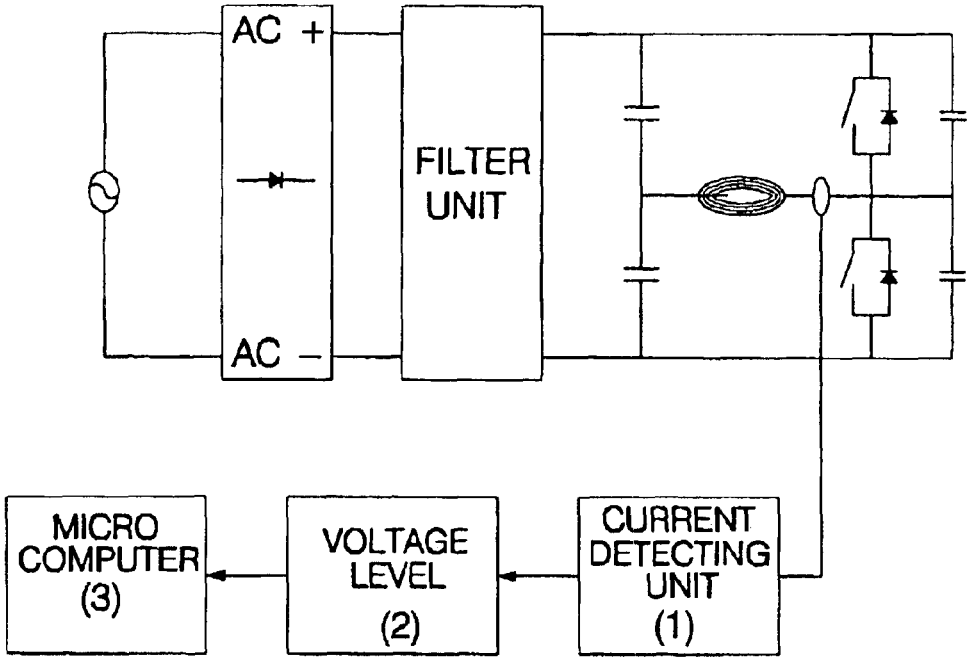
FIG. 1 (Prior Art)
FIG. 1 is a block diagram illustrating configurations of an inverter circuit and a container material discriminating unit included in a conventional induction heating cooker.
Figure 2:
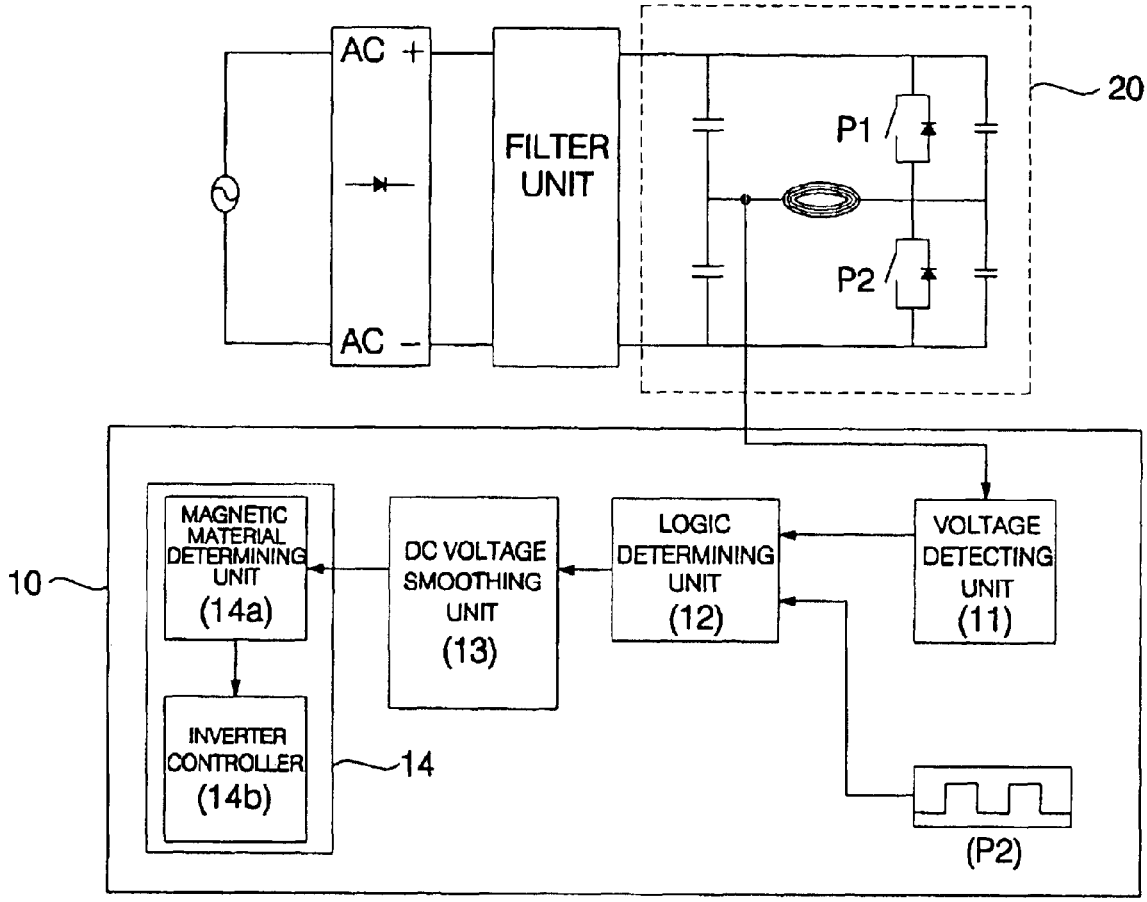
FIG. 2 is a block diagram illustrating the configuration of a container material discriminating unit included in an induction heating cooker according to the present invention.
Figure 3:
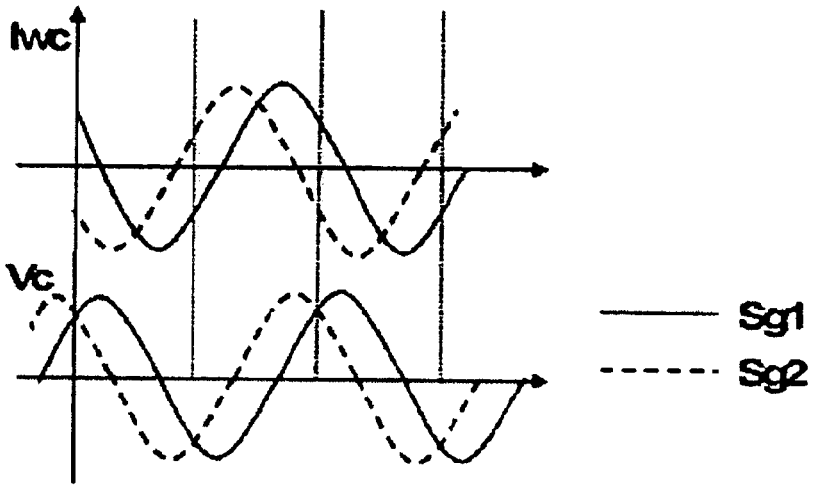
FIG. 3 is a graph depicting the waveform of current flowing through a coil included in an inverter circuit according to the present invention, and the waveform of a resonant capacitor voltage according to the present invention.
Figure 4:
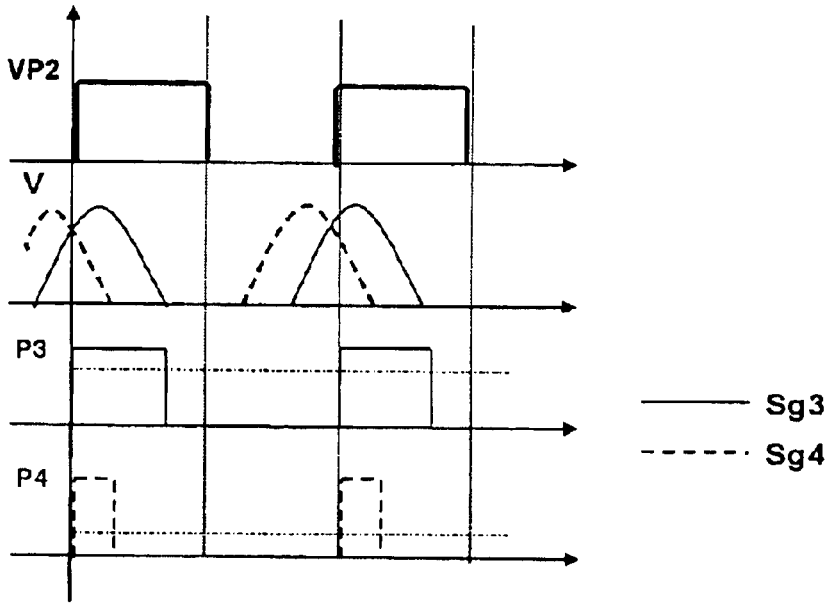
FIG. 4 is a waveform diagram of signals generated in association with operation of the container material discriminating unit according to the present invention.
Figure 5:
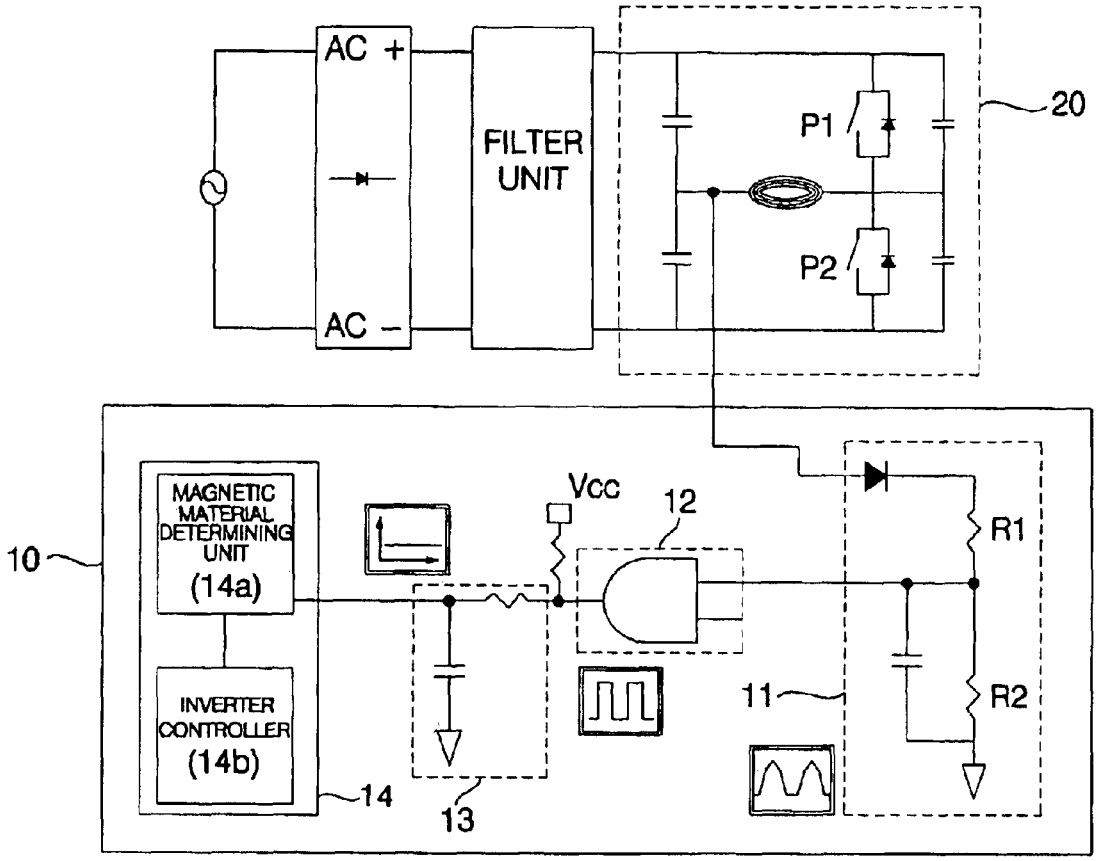
FIG. 5 is a circuit diagram illustrating a detailed configuration of the container material discriminating unit according to the present invention.
Figure 6:
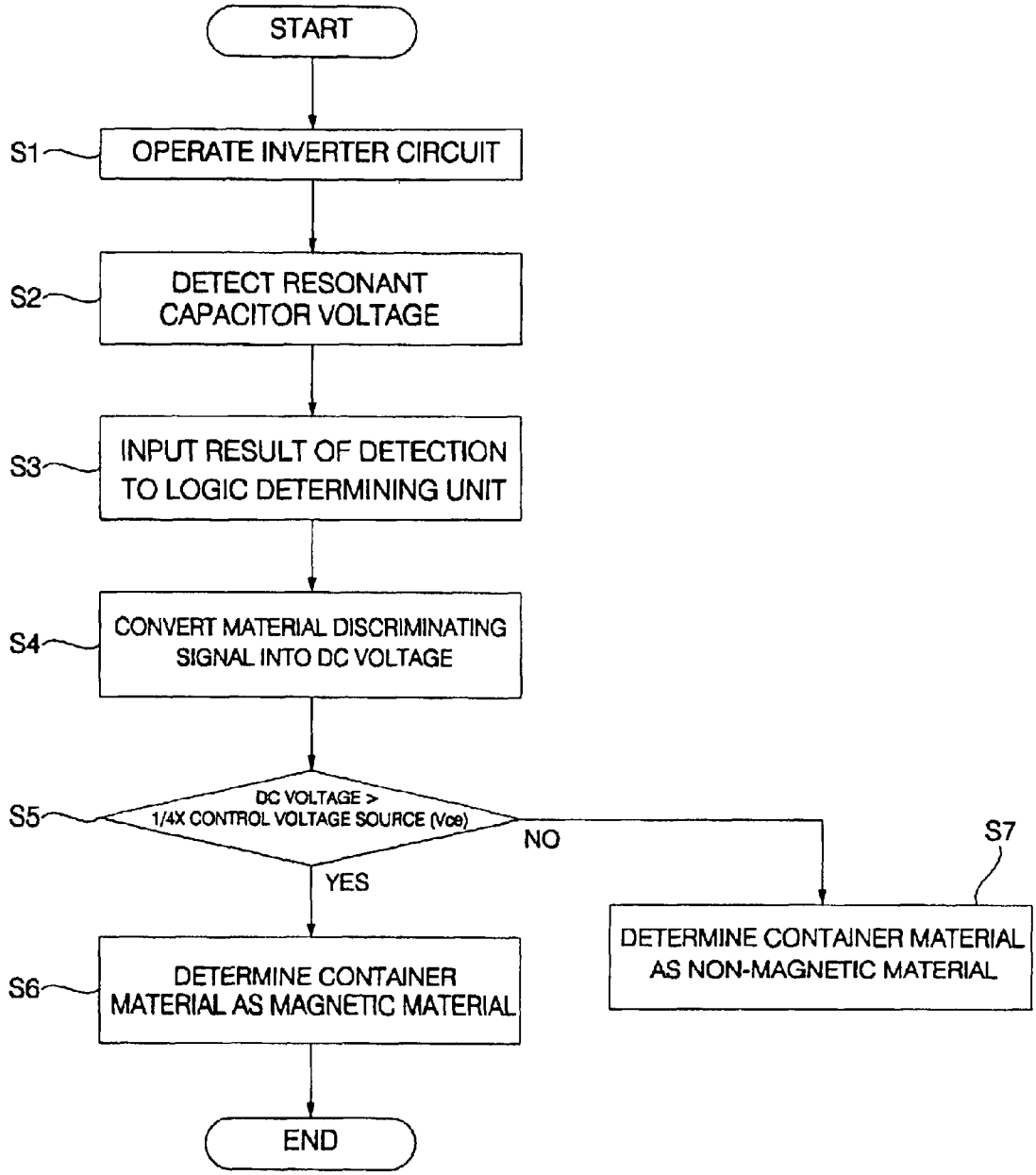
FIG. 6 is a flow chart illustrating an operation of the container material discriminating unit in the induction heating cooker according to the present invention.

FIG. 2 is a block diagram illustrating the configuration of a container material discriminating unit included in the induction heating cooker according to the present invention. FIG. 3 is a graph depicting the waveform of current flowing through a coil included in an inverter circuit according to the present invention, and the waveform of a resonant capacitor voltage according to the present invention. FIG. 4 is a waveform diagram of signals generated in association with operation of the container material discriminating unit according to the present invention. FIG. 5 is a circuit diagram illustrating a detailed configuration of the container material discriminating unit according to the present invention. FIG. 6 is a flow chart illustrating an operation of the container material discriminating unit in the induction heating cooker according to the present invention.

The induction heating cooker of the present invention includes a power supply adapted to supply a DC voltage. The power supply includes a rectifier (not shown) for rectifying a general AC voltage, thereby producing a DC voltage, and a filter (not shown) for filtering the rectified voltage. The induction heating cooker also includes an inverter circuit 20 for heating a cooking container placed in the induction heating cooker, using the voltage supplied from the power supply.

In particular, the induction heating cooker of the present invention further includes a container material discriminating unit 10 for discriminating whether the material of a cooking container placed in the induction heating cooker is magnetic or non-magnetic, based on a resonant capacitor voltage of the inverter circuit 20, and a switching pulse signal of the inverter circuit 20, so as to control the heating operation of the induction heating cooker.

As shown in FIG. 2, the container material discriminating unit 10 includes a logic determining unit 12 for comparing the resonant capacitor voltage of the inverter circuit 20 with the switching pulse signal of the inverter circuit 20, thereby outputting a pulse signal having a pulse width determined depending on the material of the cooking container.

The container material discriminating unit 10 also includes a voltage detecting unit 11. The voltage detecting unit 11 detects the resonant capacitor voltage of the inverter circuit 20, half-wave rectifies the detected voltage, divides the half-wave-rectified voltage, and outputs the resultant voltage to the logic determining unit 12. The container material discriminating unit 10 further includes a DC voltage smoothing unit 13 for converting the pulse signal outputted from the logic determining unit 12 into a DC voltage, and a microcomputer 14 for determining, based on the DC voltage, whether the material of the cooking container is magnetic or non-magnetic, and controlling the inverter circuit 20, based on the result of the determination.

The voltage detecting unit 11 is electrically connected to the inverter circuit 20 to detect the resonant capacitor voltage of the inverter circuit 20. The voltage detecting unit 11 half-wave rectifies the detected voltage, divides the half-wave-rectified voltage, and outputs the resultant voltage to the logic determining unit 12.

In particular, the container material discriminating unit 10 utilizes characteristics of a resonance frequency varying depending on a variation in the load according to a variation in the material of the cooking container, in order to discriminate the material of the cooking container. That is, the voltage detecting unit 11 detects the resonant capacitor voltage of the inverter circuit 20, and sends a voltage signal indicative of the result of the detection to the logic determining unit 12. The voltage signal outputted from the voltage detecting unit 11 has a particular phase corresponding to the material of the cooking container, so that it is possible to determine the material of the cooking container, based on a variation in the phase of the voltage signal.

The logic determining unit 12 receives the voltage signal outputted from the voltage detecting unit 11 and the switching pulse signal of the inverter circuit 20, and compares the received signals, thereby outputting a material discriminating signal. The material discriminating signal has a pulse width varying depending on the material of the cooking container within respective phase variation ranges of the switching pulse signal and resonance capacitor voltage.

The DC voltage smoothing unit 13 receives the material discriminating signal from the logic determining unit 12, and outputs the material discriminating signal in the form of a smooth DC voltage. The DC voltage from the DC voltage smoothing unit 13 is applied to the microcomputer 14. Based on the DC voltage applied thereto, the microcomputer 14 determines whether the material of the cooking container is magnetic or non-magnetic. Based on the result of the determination, the microcomputer 14 controls the inverter circuit 20.

The microcomputer 14 includes a magnetic material determining unit 14*a* for comparing the DC voltage outputted from the DC voltage smoothing unit 13 with a reference value stored in the magnetic material determining unit 14*a*, thereby determining whether the material of the cooking container is magnetic or non-magnetic, and an inverter controller 14*b* for activating the inverter circuit 20 when it is determined that the material of the cooking container is magnetic, so as to heat the cooking container.

If the DC voltage is not less than ¼ of the control voltage source(Vce), the magnetic material determining unit 14*a* determines that the material of the cooking container is magnetic. If not, the magnetic material determining unit 14*a* determines that the material of the cooking container is non-magnetic.

As shown in FIG. 3, the waveform of current flowing through the coil of the inverter circuit 20 and the waveform of the resonant capacitor voltage of the inverter circuit 20 exhibit a variation in phase depending on the material of the cooking container. That is, different phases are exhibited in accordance with whether the material of the cooking container is magnetic or non-magnetic, as indicated by waveforms Sg1 and Sg2, respectively.

That is, the current $I_{wc}$ flowing through the coil exhibits different phases when the material of the cooking container is magnetic (Sg1) and when the material of the cooking container is non-magnetic (Sg2), respectively. Similarly, the resonant capacitor voltage $V_c$, which has a phase difference of 90° from the coil current, exhibits different phases when the material of the cooking container is magnetic (Sg1) and when the material of the cooking container is non-magnetic (Sg2), respectively.

The coil current and resonant capacitor voltage have different phases, respectively. The voltage detecting unit 11 detects the resonant capacitor voltage $V_c$, and outputs a voltage signal indicative of the result of the detection. In accordance with the present invention, the material of the cooking container is determined, using the phase variation characteristics of the resonant capacitor voltage $V_c$ depending on the material of the cooking container.

The logic determining unit 12 compares the voltage signal outputted from the voltage detecting unit 11 with the switching pulse signal of the inverter circuit 20, and outputs a material discriminating signal, which is a pulse signal. As shown in FIG. 4, the voltage signal has a level varying depending on whether the material of the cooking material is magnetic or non-magnetic, as indicated by waveforms Sg3 and Sg4.

The logic determining unit 12 logically ANDs the output voltage signal of the voltage detecting unit 11 and the switching pulse signal of the inverter circuit 20, thereby outputting a pulse signal. The pulse signal outputted from the logic determining unit 12 is set to have a pulse width ranging from ¼ to ½ of the period of the switching pulse signal when the material of the cooking material is magnetic (Sg3). When the material of the cooking material is non-magnetic (Sg4), the pulse signal is set to have a pulse width ranging from 0 to ¼ of the period of the switching pulse signal.

Thus, the material discriminating signal outputted from the logic determining unit 12 has a pulse width varying depending on whether the material of the cooking container is magnetic or non-magnetic. As shown in FIG. 4, the logic determining unit 12 outputs a pulse signal P3 when the material of the cooking container is magnetic (Sg3), while outputting a pulse signal P4 when the material of the cooking container is non-magnetic.

Hereinafter, the configuration of the container material discriminating unit 10 will be described in more detail with reference to FIG. 5.

The voltage detecting unit 11 includes a diode, a capacitor and a plurality of resistors. In the illustrated case, two resistors, that is, first and second resistors R1 and R2, are used. The voltage detecting unit 11 detects the voltage of the resonant capacitor included in the inverter circuit 20, half-wave rectifies the detected voltage, divides the half-wave-rectified voltage, and outputs the resultant voltage to the logic determining unit 12. The voltage division is carried out in accordance with the resistance ratio between the first and second resistors R1 and R2.

The logic determining unit 12 includes an AND gate. The AND gate receives the output voltage signal from the voltage detecting unit 11 and the switching pulse signal of the inverter circuit 20, and compares the received signals. Thus, the AND gate outputs a material discriminating signal having a pulse width varying depending on whether the material of the cooking container is magnetic or non-magnetic.

In this case, the pulse width of the material discriminating signal outputted from the logic determining unit 12 is variable within respective phase variation ranges of the switching pulse signal and resonance capacitor voltage in accordance with the present invention. Accordingly, it is possible to output a signal having a pulse width varying depending on the material of the cooking container, irrespective of a variation in the load of the cooking container.

The DC voltage smoothing unit 13 includes a low pass filter consisting of a resistor and a capacitor. With this configuration, the DC voltage smoothing unit 13 filters the material discriminating; signal outputted from the logic determining unit 12, thereby outputting a smooth DC voltage.

Operation of the induction heating cooker having the above-described configuration according to the present invention will be described with reference to FIG. 6, which is a flow chart illustrating the operation sequence of the container material discriminating unit.

The induction heating cooker receives an input DC voltage from the power supply, which rectifies and filters an input AC voltage. By the input DC voltage, the inverter circuit 20 is operated (S1).

Thereafter, a resonant capacitor voltage generated in accordance with the operation of the inverter circuit 20 is detected by the voltage detecting unit 11. The detected resonant capacitor voltage is sine-wave rectified. The rectified voltage is divided by the resistors of the voltage detecting unit 11 in accordance with the resistance ratio between the resistors. The divided voltage is outputted (S2).

The divided voltage is applied to the AND gate of the logic determining unit 12, along with the switching pulse signal of the inverter circuit 20, so that the applied signals are compared (S3).

Where the material of the cooking container is magnetic, the AND gate outputs, as a material discriminating signal, a pulse signal having a pulse width corresponding to ¼ to ½ of the period of the switching pulse signal. On the other hand, where the material of the cooking container is non-magnetic, the AND gate outputs, as a material discriminating signal, a pulse signal having a pulse width corresponding to 0 to ½ of the period of the switching pulse signal.

The material discriminating signal passes through the low pass filter of the DC voltage smoothing unit 13, which consists of one resistor and one capacitor, so that the material discriminating signal is outputted in the form of a smooth DC voltage (S4).

The smooth DC voltage is applied to the microcomputer 14, which in turn compares the DC voltage with a reference value stored in the microcomputer 14 (S5).

If the DC voltage has a level corresponding to 25% or more of the control voltage source(Vce), the microcomputer 14 determines that the material of the cooking container is magnetic (S6). If not, the microcomputer 14 determines that the material of the cooking container is non-magnetic (S7).

When it is determined that the material of the cooking container is magnetic, the inverter circuit 20 is operated to heat the cooking container. On the other hand, when it is determined that the material of the cooking container is non-magnetic, the inverter circuit 20 is not operated.

As apparent from the above description, the induction heating cooker having the above-described configuration according to the present invention can accurately discriminate the material of the cooking container, irrespective of the load of the cooking container. That is, it is possible to prevent the induction heating cooker from operating erroneously due to an erroneous determination of the container material discriminating unit as to the material of the cooking container, which may occur at the boundary of the load between a load value corresponding to the magnetic material and a load value corresponding to the non-magnetic material.

Since the induction heating cooker includes the container material discriminating unit, which is adapted to discriminate whether the material of the cooking container is magnetic or non-magnetic, it is possible to use a simple voltage detector, without using an expensive current detector. The logic determining unit can also be implemented using a general logic element, that is, an AND gate. Accordingly, a great reduction in manufacturing costs is achieved.

In accordance with the reduction in manufacturing costs achieved using a simple logic configuration, there are an enhancement in the reliability of products and an improvement in price competitiveness.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An induction heating cooker comprising:

a power supply for rectifying an AC voltage, filtering the rectified voltage, and supplying the filtered voltage as an input voltage of the induction heating cooker;

an inverter circuit for heating a cooking container placed in the induction heating cooker, using the voltage supplied from the power supply; and a container material discriminating unit for discriminating whether a material of the cooking container is magnetic or non-magnetic, based on a resonant capacitor voltage of the inverter circuit and a switching pulse signal of the inverter circuit, upon an initial operation of the induction heating cooker, whereby the cooking container is selectively heated in accordance with the result of the discrimination.

2. The induction heating cooker according to claim 1, wherein the container material discriminating unit comprises:

a voltage detecting unit for detecting the resonant capacitor voltage of the inverter circuit, half-wave rectifying the detected voltage, dividing the half-wave-rectified voltage, and outputting the divided voltage as the result of the detection; and a logic determining unit for comparing the voltage outputted from the voltage detecting unit with the switching pulse signal of the inverter circuit, thereby outputting a pulse signal having a pulse width varying depending on whether the material of the cooking container is magnetic or non-magnetic.

3. The induction heating cooker according to claim 2, wherein the container material discriminating unit further comprises:

a DC voltage smoothing unit for converting the pulse signal outputted from the logic determining unit into a DC voltage; and a micro computer for determining, based on the DC voltage, whether the material of the cooking container is magnetic or non-magnetic, and controlling the inverter circuit, based on the result of the determination.

4. The induction heating cooker according to claim 3, wherein the DC voltage smoothing unit comprises a low pass filter for smoothing the pulse signal received from the logic determining unit in the form of a DC voltage.

5. The induction heating cooker according to claim 3, wherein the microcomputer comprises:

a magnetic material determining unit for comparing the DC voltage outputted from the DC voltage smoothing unit with a reference value, thereby determining that the material of the cooking container is magnetic when the DC voltage is not less than ¼ of the control voltage source(Vce), while determining that the material of the cooking container is non-magnetic when the DC voltage is less than ¼ of the control voltage source(Vce); and an inverter controller for activating the inverter circuit when it is determined that the material of the cooking container is magnetic, so as to heat the cooking container.

6. The induction heating cooker according to claim 2, wherein the logic determining unit comprises an AND gate for outputting a pulse signal having a pulse width varying in accordance with a variation in load depending on the material of the cooking container such that the pulse width of the pulse signal varies within a range from ¼ to ½ of a period of the switching pulse signal when the material of the cooking material is magnetic, while varying within a range from 0 to ¼ of the period of the switching pulse signal when the material of the cooking material is non-magnetic.

7. The induction heating cooker according to claim 2, wherein the voltage detecting unit comprises a plurality of resistors for dividing a voltage applied thereto in accordance with a resistance ratio thereof.

8. The induction heating cooker according to claim 1, wherein the power supply comprises:

a power source for supplying a general AC voltage;

a rectifier for rectifying the AC voltage; and a filter for filtering the rectified voltage.

9. A method for operating an induction heating cooker, comprising the steps of:

A) operating an inverter circuit included in the induction heating cooker upon an initial operation of the induction heating cooker;

B) outputting, as a material discriminating signal, a pulse signal having a pulse width varying depending on a material of a cooking container placed in the induction heating cooker, based on a resonant capacitor voltage of the inverter circuit and a switching pulse signal of the inverter circuit;

C) determining whether the material of the cooking container is magnetic or non-magnetic, based on the material discriminating signal outputted at the step B); and D) operating the inverter circuit when it is determined at the step C) that the material of the cooking container is magnetic, thereby heating the cooking container.

10. The method according to claim 9, wherein the step B) comprises the steps of:

detecting the resonant capacitor voltage of the inverter circuit;

sine-wave rectifying the detected voltage;

dividing the rectified voltage, comparing the divided voltage with the switching pulse signal of the inverter circuit; and outputting the result of the comparison as the material discriminating signal.

11. The method according to claim 9, wherein the step C) comprises the steps of:

converting the pulse signal outputted at the step B) into a DC voltage;

comparing the DC voltage with a predetermined reference value;

determining that the material of the cooking container is magnetic when the DC voltage has a level not less than 25% of the control voltage source(Vce); and determining that the material of the cooking container is non-magnetic when the DC voltage has a level less than 25% of the control voltage source(Vce).

* * * * *